US006280320B1

(12) United States Patent
Paschke et al.

(10) Patent No.: US 6,280,320 B1
(45) Date of Patent: Aug. 28, 2001

(54) FRAME TO SUPPORT A DEFLATED FABRIC AIR DUCT

(75) Inventors: Nicolas B. Paschke, Milwaukee, WI (US); Thomas J. Boffeli, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/353,475

(22) Filed: Jul. 13, 1999

(51) Int. Cl.[7] ..... F24F 13/072

(52) U.S. Cl. ..... 454/298; 454/296; 454/306; 454/334

(58) Field of Search ..... 454/284, 296, 454/298, 306, 334

(56) References Cited

U.S. PATENT DOCUMENTS

| | | | | |
|---|---|---|---|---|
| 2,423,241 | * | 7/1947 | Kurth et al. | 454/306 |
| 3,357,088 | * | 12/1967 | Hoffman et al. | 454/306 X |
| 5,123,595 | * | 6/1992 | Koss | 454/306 X |

FOREIGN PATENT DOCUMENTS

| | | | | |
|---|---|---|---|---|
| 0 175 892 | * | 4/1986 | (EP) | 454/306 |
| 0 840 072 A2 | | 5/1998 | (EP) . | |
| 0 899 519 A1 | | 3/1999 | (EP) . | |
| 2 713 317 | | 6/1995 | (FR) . | |
| 63-3143 | * | 1/1988 | (JP) | 454/296 |
| 3-110342 | * | 5/1991 | (JP) | 454/296 |

OTHER PUBLICATIONS

*International Search Report* corresponding to International application Ser. No. PCT/US00/19145, dated Oct. 17, 2000, 8 pages.

* cited by examiner

*Primary Examiner*—Harold Joyce
(74) *Attorney, Agent, or Firm*—Marshall, O'Toole, Gerstein, Murray & Borun

(57) ABSTRACT

A flexible air duct is provided for conveying and distributing a source of forced air to a room or other area of a building. The air duct includes a flexible outer casing made of an air permeable fabric that evenly disperses the air into the room. To prevent the fabric from sagging when the source of forced air is periodically turned off, a support frame holds the casing in a generally open tubular shape even when the duct's interior and exterior air pressures are the same.

8 Claims, 6 Drawing Sheets

FRAME TO SUPPORT A DEFLATED FABRIC AIR DUCT

BACKGROUND OF THE INVENTION

1. Field of the Invention

The subject invention generally pertains to flexible fabric air ducts and more specifically to a frame that supports the duct when it is deflated.

2. Description of Related Art

Ductwork is often used to convey conditioned air (e.g., heated, cooled, filtered, etc.) discharged from a fan and to distribute the air to a room or other areas within a building. Ducts are typically formed of rigid metal, such as steel, aluminum, or stainless steel. In many installations, ducts are hidden above suspended ceilings for convenience and aesthetics. But in warehouses, manufacturing plants and many other buildings, the ducts are suspended from the roof of the building and are thus exposed. In those warehouse or manufacturing environments where prevention of air-borne contamination of the inventory is critical, metal ducts can create problems.

For example, temperature variations in the building, or temperature differentials between the ducts and the air being conveyed can create condensation on both the interior and exterior of the ducts. The presence of condensed moisture on the interior of the duct may form mold or bacteria that the duct then passes onto the room or other areas being supplied with the conditioned air. In the case of exposed ducts, condensation on the exterior of the duct can drip onto the inventory or personnel below. The consequences of the dripping can range anywhere from a minor irritation to a dangerously slippery floor for the personnel, or complete destruction of the products it may drip on (especially in food-processing facilities).

Further, metal ducts with localized discharge registers have been known to create uncomfortable drafts and unbalanced localized heating or cooling within the building. In many food-processing facilities where the target temperature is 42 degrees Fahrenheit, a cold draft can be especially uncomfortable and possibly unhealthy.

Many of the above problems associated with metal ducts are overcome by the use of flexible fabric ducts, such as a DUCTSOX by the Frommelt Safety Products Corporation of Milwaukee, Wis. Such ducts typically have a flexible fabric wall (often porous) that inflates to a generally cylindrical shape by the pressure of the air being conveyed by the duct. Fabric ducts seem to inhibit the formation of condensation on its exterior wall, possibly due to the fabric having a lower thermal conductivity than that of metal ducts. In addition, the fabric's porosity and/or additional holes distributed along the length of the fabric duct broadly and evenly disperse the air into the room being conditioned or ventilated. The even distribution of airflow also effectively ventilates the walls of the duct itself, thereby further inhibiting the formation of mold and bacteria.

However, in many cases, once the room's conditioning demand has been met, the air supply fan is turned off until needed again. When the fan is off, the resulting loss of air pressure in the duct deflates the fabric tube: causing it to sag. Depending on the application and material of the fabric, in some cases, the sagging creates a poor appearance or may interfere with whatever might be directly beneath the duct.

SUMMARY OF THE INVENTION

In order to inhibit a fabric air duct from sagging when deflated, a frame is provided to maintain a flexible fabric outer casing of the duct in a generally expanded shape, even when the duct's interior and exterior air pressures are the same. The fabric outer casing is air-permeable to evenly disperse air into an area being served by the duct and is removable from the frame to facilitate washing the fabric and reinstalling it afterwards.

Providing a fabric air duct with a frame that maintains a flexible outer casing in a generally expanded shape may inhibit the growth of mold and bacteria within the casing at times when there is no airflow through the duct.

A frame that maintains a fabric air duct in a generally expanded shape reduces the extent to which the fabric sags when the duct's interior and exterior air pressures are the same.

In some embodiments, adjustable air discharge openings are incorporated in the same frame that helps hold the air duct's fabric outer casing in a generally expanded shape.

An air duct that includes a frame with a removable outer casing made of fabric allows the fabric to be periodically machine washed and reinstalled on the frame.

One embodiment of a fabric duct whose frame holds an outer casing open when deflated further allows the casing to be removed without having to slide it out from one end of the frame where space may be limited in some applications.

DESCRIPTION OF THE PREFERRED EMBODIMENT

Figure 1:
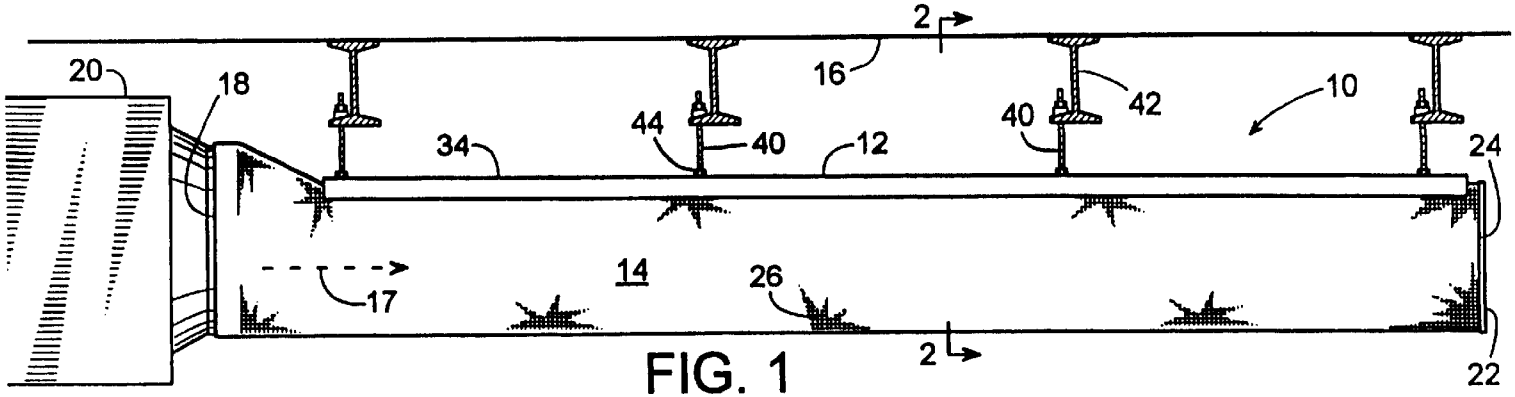
FIG. 1 is a side view of a fabric air duct held in a partially expanded state by a support frame.
Figure 3:
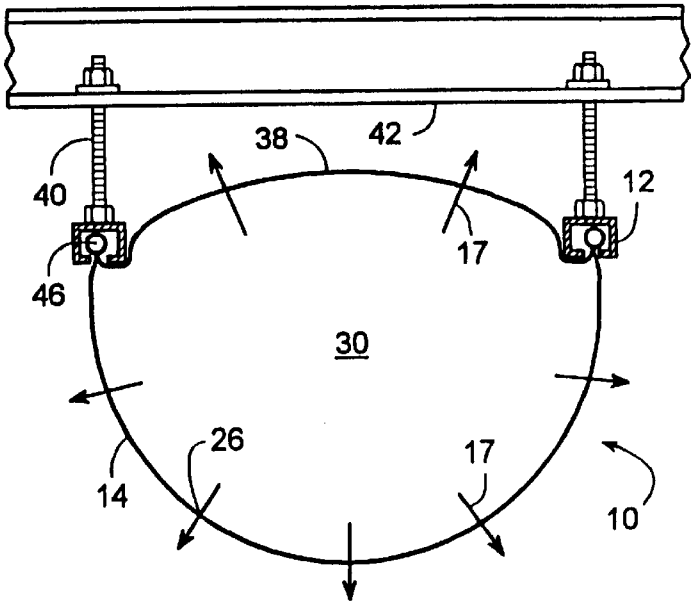
FIG. 3 is the same view as FIG. 2, but with the fabric air duct inflated to a fully expanded state.
Figure 2:
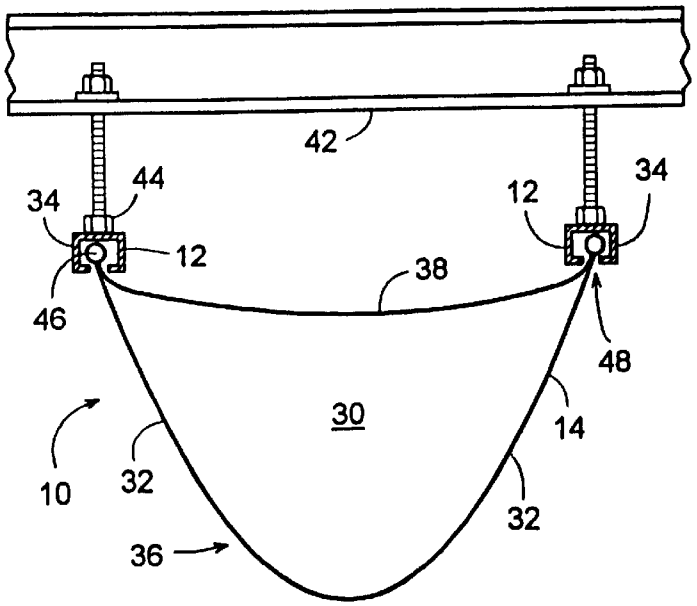
FIG. 2 is a sectional view taken along line 2—2 of FIG. 1.

One example of an elongated fabric air duct 10 that includes a frame 12 to help hold a flexible outer casing 14 in a generally open tubular shape is shown in FIGS. 1–3. In this embodiment, duct 10 is suspended from an overhead portion of a building to run generally parallel to its ceiling 16 and deliver air 17 to specific rooms or desired areas of the building. Depending on the application, the air may be for ventilation purposes only, or may be conditioned by heat, cooling, filtering, humidifying, dehumidification, and various combinations thereof.

One end of duct 18 is open to receive a supply of air 17 typically provided by a fan discharging forced air directly into open end 18 or into transitional ductwork such as a supply header 20, which, in turn, feeds several distribution ducts, such as duct 10. An end piece 22, made of fabric or some other material, at least partially blocks off an opposite end 24 of outer casing 14 to maintain some positive pressure within duct 10. An example of a partially opened end cap is disclosed in U.S. Pat. No. 5,655,963, which is specifically incorporated by reference herein. A positive pressure within duct 10 inflates outer casing 14 to an expanded state, as shown in FIG. 3. From within duct 10, air can be delivered or dispersed into the desired areas of the building by a variety of ways.

One way is to make outer casing 14 out of a porous, air-permeable material to provide casing 14 with countless minute discharge apertures 26 that leak to evenly disperse the air into the room. If desired, higher airflow rates are achieved by using a fabric that is more porous, or by cutting larger holes 28 in an outer casing that is not necessarily porous (see embodiment of FIG. 4). Additional holes can also be provided by an air-dispersing panel, as disclosed in U.S. Pat. No. 5,769,708, which is specifically incorporated by reference herein. The size, quantity and distribution of the discharge apertures depend on the specific airflow requirements of the room or area being served.

In many applications, the fan is periodically turned on and off, so that over time the air discharged into the room matches its need for conditioned air. During the periods when the fan is turned off, there is insufficient air pressure within duct 10 to hold it open, as shown in FIG. 2. Consequently, to prevent the fabric casing 14 from collapsing and sagging excessively, frame 12 helps hold it open to maintain an air passageway 30 between two horizontally opposing, fabric side panels 32. Horizontally opposing sides refers to portions of casing 14 that are disposed side-by-side in horizontal displacement in relation to each other, as opposed to one being above the other.

To provide the horizontal separation, in one embodiment, frame 12 includes two generally parallel attachment members (e.g., channels 34) that are spaced apart to hold side panels 32 apart. Each channel 34 does not necessarily have to be a single continuous channel extending the full length of duct 10, but can be comprised of several segments each extending along a length of duct 10 and placed end-to-end as indicated by interface 35 of FIG. 1. Side panels 32 hang from channels 34 and come together at the bottom to comprise a lower portion 36 of casing 14. An upper portion 38 of casing 14 joins two upper edges of side panels 32 to render casing 14 a tubular structure. Upper portion 38 can be of the same material as the fabric in lower portion 36, but can also be of another fabric or even a rigid impermeable member that holds channels 34 apart. However, in this exemplary embodiment, channels 34 are simply held apart by hangers 40 that separately suspend each channel 34 from I-beams 42, plumbing, the ceiling or other overhead structure that may be conveniently available. In a schematically illustrated example, hangers 40 are threaded rods having an upper end bolted to I-beam 40, and a lower end threaded into a nut 44 that has been welded to an upper side of a channel 34. Of course, this is just one of numerous common techniques of hanging or mounting an attachment member overhead.

To facilitate servicing or washing the fabric outer casing 14, it is removably attached to channels 34 by way of an elongated bead 46 that is sewn, or otherwise attached, to the upper edge of each side panel 32. Each bead 46 is wider than a lower slit 48 in each channel 34 to allow each bead 46 to slide lengthwise into one of the channels, while the bead's width prevents it from falling out through slit 48. Installing casing 14 involves sliding it through channels 34 from right to left in FIG. 1. The open end 18 of casing 14 is pulled completely through channels 34 and wrapped around or otherwise attached to whatever air handling device is to supply the conditioned air, such as supply header 20. It should be noted that bead 46 engaging channel 34 is an exemplary embodiment that represents a wide variety of fastening devices well know to those skilled in the art. For example, other fastening devices well within the scope of the invention include, but are not be limited to, zippers, snaps, hooks, Velcro, etc.

Figure 4:
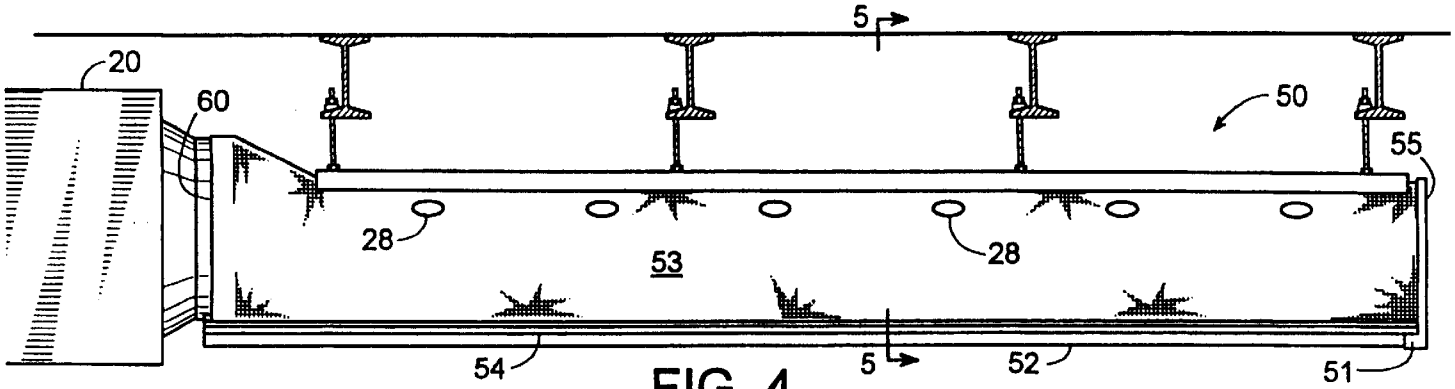
FIG. 4 is a side view of another embodiment of a fabric air duct held in a partially expanded state by a support frame.
Figure 6:
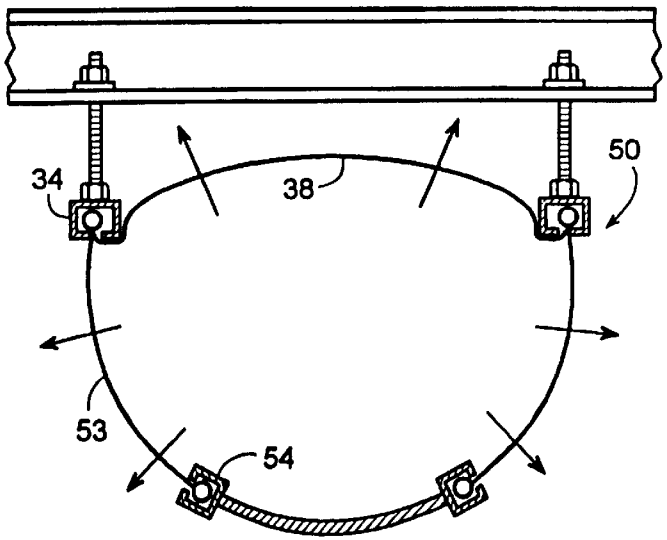
FIG. 6 is the same view as FIG. 5, but with the fabric air duct inflated to a fully expanded state.
Figure 5:
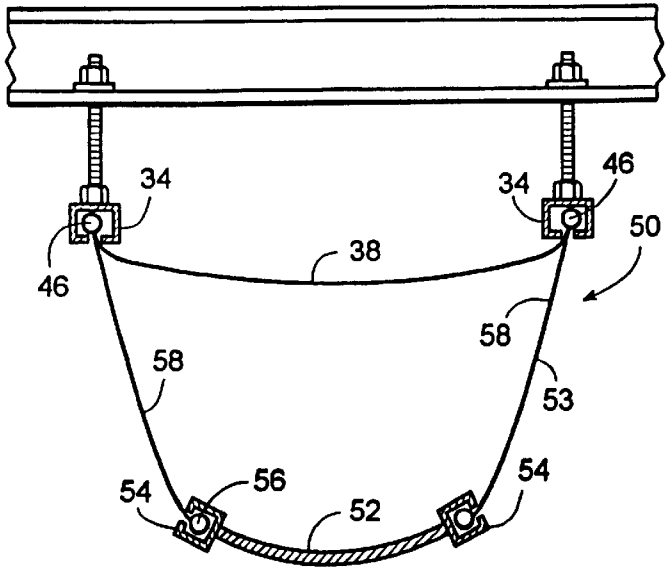
FIG. 5 is a sectional view taken along line 5—5 of FIG. 4.

To further enhance a full, open appearance of a deflated casing, an air duct 50 illustrated in FIGS. 4–6 includes a rigid or semi-rigid bottom panel 52 that helps hold a fabric outer casing 53 in an open tubular shape. Duct 50 is shown deflated in FIG. 5 and inflated in FIG. 6. Bottom panel 52 includes two side channels 54 that are similar to channels 34. Side channels 54 slidingly receive elongated beads 56 disposed along a lower edge of two individual fabric side panels 58. Side panels 58, upper portion 38 and bottom panel 52 together provide a tubular structure having an open end 60 coupled to an air supply, e.g., header 20, and an opposite end at least partially closed off by a fabric end cap 55. In this example, end cap 55 is sewn to side panels 58 and upper portion 38. Referring to FIG. 4, the right lower edge of duct 50 is closed off by a bottom flap 51 that extends from end cap 55 and removably attaches to an underside of bottom panel 52 by way of a touch and hold fastener, such as VELCRO. The touch and hold fastener and sliding fits of bead 46 and 56 within channels 34 and 54 make it easy to remove the fabric portions of duct 50 for the purpose of machine washing.

Figure 7:
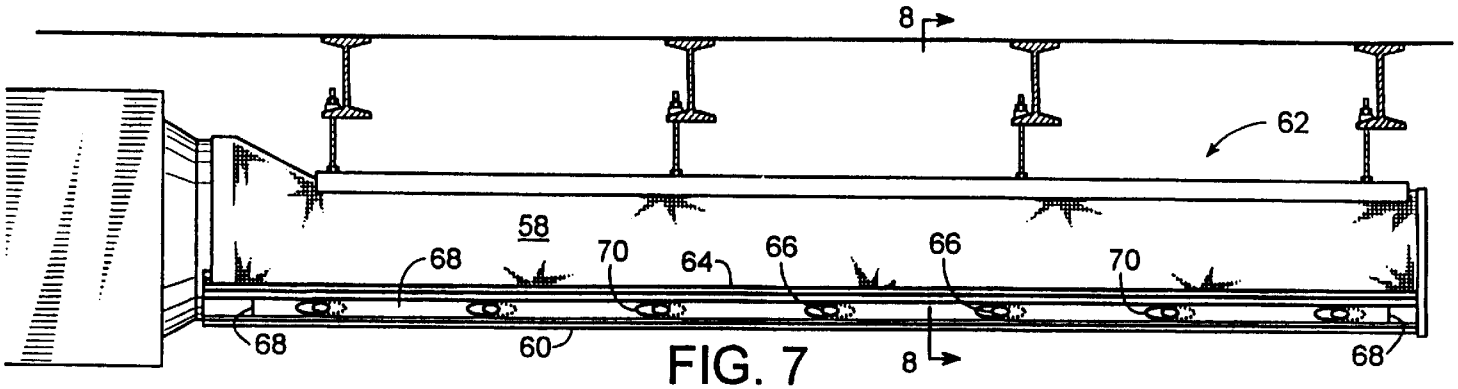
FIG. 7 is a side view of another embodiment of a fabric air duct held in a partially expanded state by a support frame.
Figure 9:
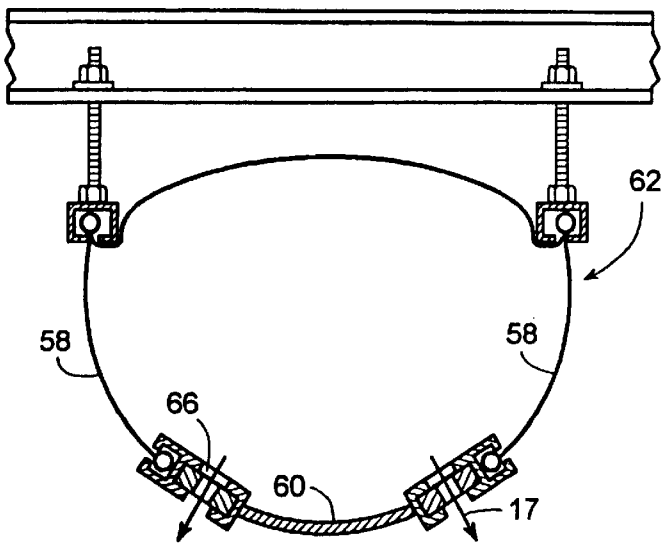
FIG. 9 is the same view as FIG. 8, but with the fabric air duct inflated to a fully expanded state.
Figure 8:
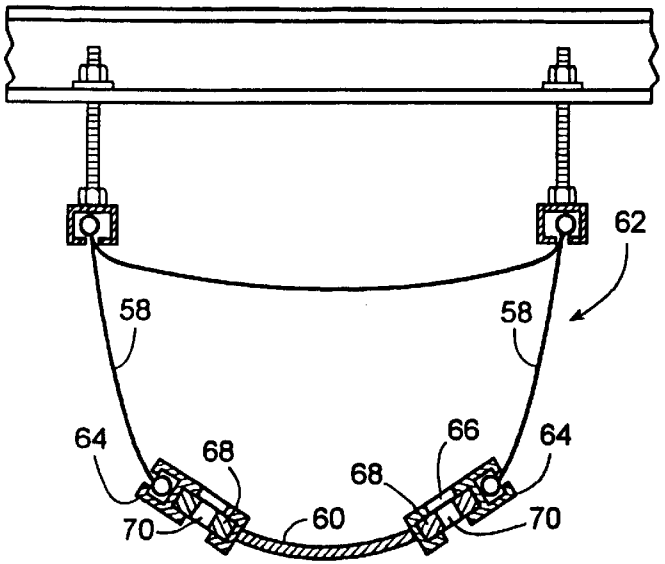
FIG. 8 is a sectional view taken along line 8—8 of FIG. 7.

A modified bottom panel 60, shown in FIGS. 7–9, provides a way to manually adjust the rate of airflow discharging from a fabric air duct 62. Duct 62 is shown deflated in FIG. 8 and inflated in FIG. 9. Panel 60 connects side panels 58 by way of two side channels 64 that function in the same way as side channels 54 of FIGS. 4–6. Panel 62 also includes a series of holes 66 through which air 17 within duct 62 discharges into the room, as shown in FIG. 9. A covering member, e.g., a cover plate 68, with a similar series of holes 70 that can be selectively aligned to holes 66 can be manually or otherwise slid lengthwise in relation to panel 60 to vary the extent to which plate 68 covers holes 66. Adjusting the extent to which holes 66 are covered by plate 68 adjusts the amount of airflow discharged from duct 62. In FIG. 7, plate 68 is shown covering about half the area of holes 66 to provide moderate airflow. In the exemplary embodiment shown, panel 60 includes two sets of holes covered by two separate plates 68; however, more or less than two sets of adjustable discharge openings are well within the scope of this embodiment.

Figure 10:
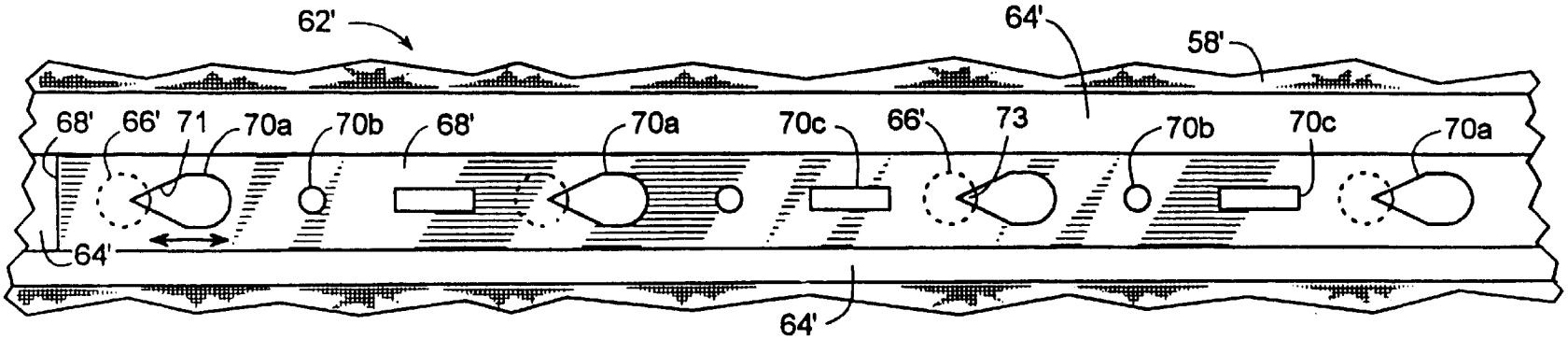
FIG. 10 is cut-away view of a sliding plate having a series of holes of variable registration with a stationary series of holes to adjust a rate of airflow.
Figure 11:
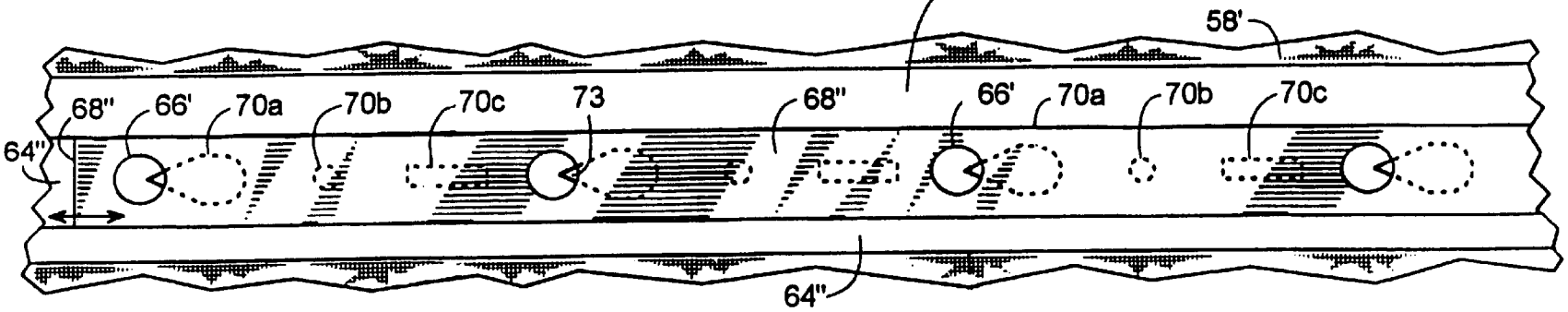
FIG. 11 is cut-away view of another embodiment of sliding plate having a series of holes of variable registration with a stationary series of holes to adjust a rate of airflow.

As a variation of air duct 62, the embodiment of FIG. 10 provides a moveable cover plate 68' with two or more sets of holes, e.g., holes 70*a,* 70*b* and 70*c* of various shape and size to selectively provide, in this example, three different airflow adjustment rates that vary as a function of their registration with holes 66'. Holes 70*a* include a triangular notch 71 that, compared to the embodiment of FIG. 9, provides a finer vernier adjustment of airflow through openings 73, but with a comparable maximum flow rate. Holes 70*b* and 70*c* also provide a finer airflow adjustment, but with a lower maximum airflow rate. Air duct 62' includes a tubular casing comprising a fabric wall 58' and a member 64' that slidingly receives cover plate 68'. Member 64' can be equivalent to channels 64 of air duct 62, or can be an integral fabric extension of fabric wall 58'. In either case, member 64' defines holes 66'. In a similar embodiment of virtually identical function, holes 70*a,* 70*b,* and 70*c* are defined by member 64" while holes 66' are in cover plate 68", as shown in FIG. 11.

Figure 12:
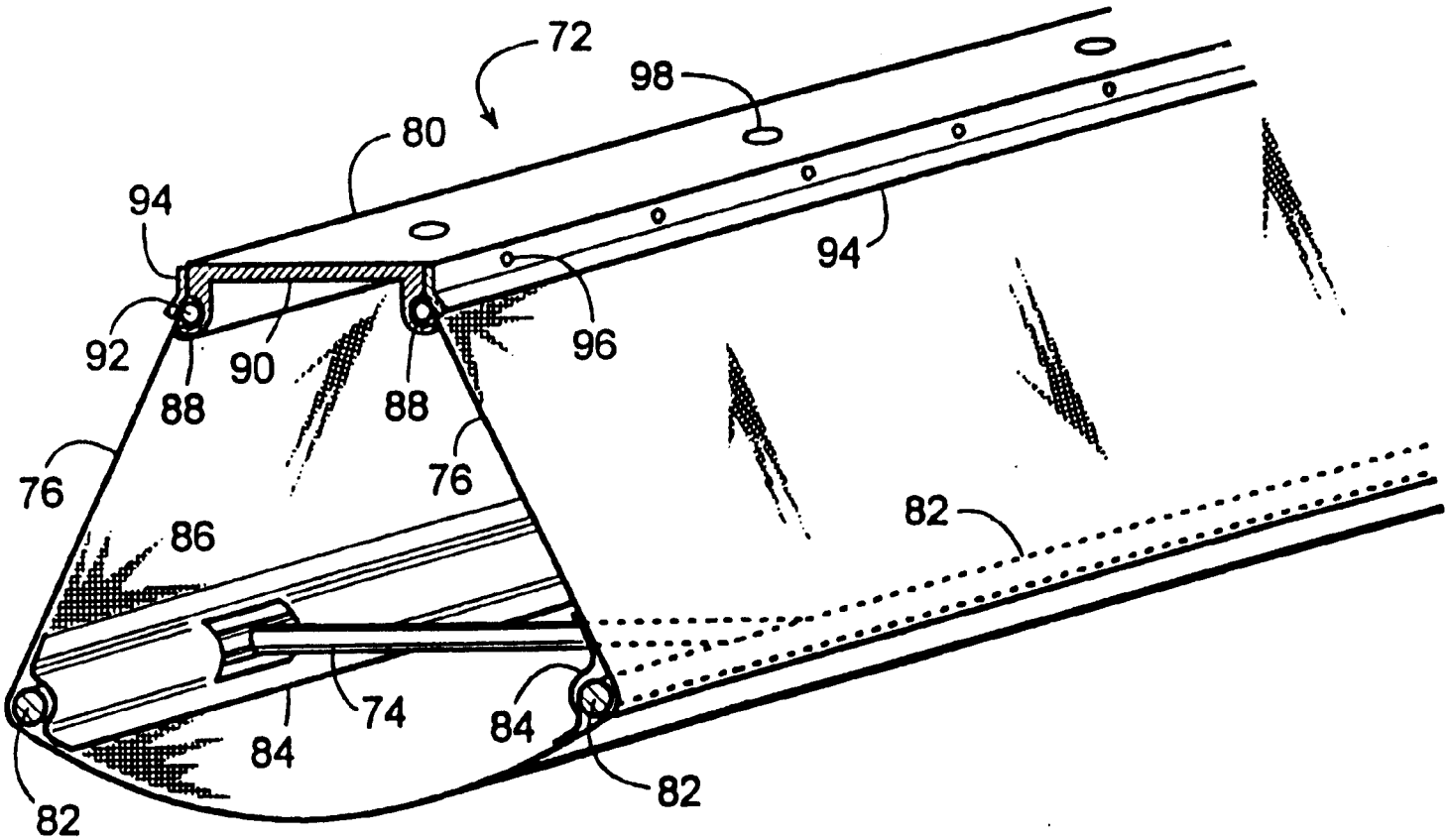
FIG. 12 is a perspective cut-away view of yet another embodiment.

In another embodiment, shown in FIG. 12, an air duct 72 includes an internal cross-brace 74 that pushes outwards to maintain a fabric outer casing 76 in an open tubular shape. Brace 74 is disposed within an air passageway 78 below a mounting frame 80 and pushes against two generally parallel rods 82 that help evenly distribute the outward force of brace 74 along the length of duct 72. In this example, two strips of material 84 are sewn to casing 76 to hold rods 82 in place. Strips 84 include openings 86 to make it easier to attach brace 74 to rods 82. Although only one brace 74 is shown, there are actually several distributed along the length of duct 72 with the total number of braces depending on the total length of duct 72.

To further help hold duct 72 open, a mounting frame 80 includes two channels 88 that are spaced apart by a rigid plate 90 to separate two upper edges of casing 76. An elongated bead 92 disposed along each upper edge of casing 76 is removably clamped within a channel 88 by a metal strip 94. In this embodiment, strip 94 attaches to frame 80 by way of screws 96; however, any one of a wide variety of other fasteners or clamps could also work. Frame 80 includes several holes 98 to facilitate mounting frame 80 overhead, such as, for example, directly against a ceiling.

Figure 13:
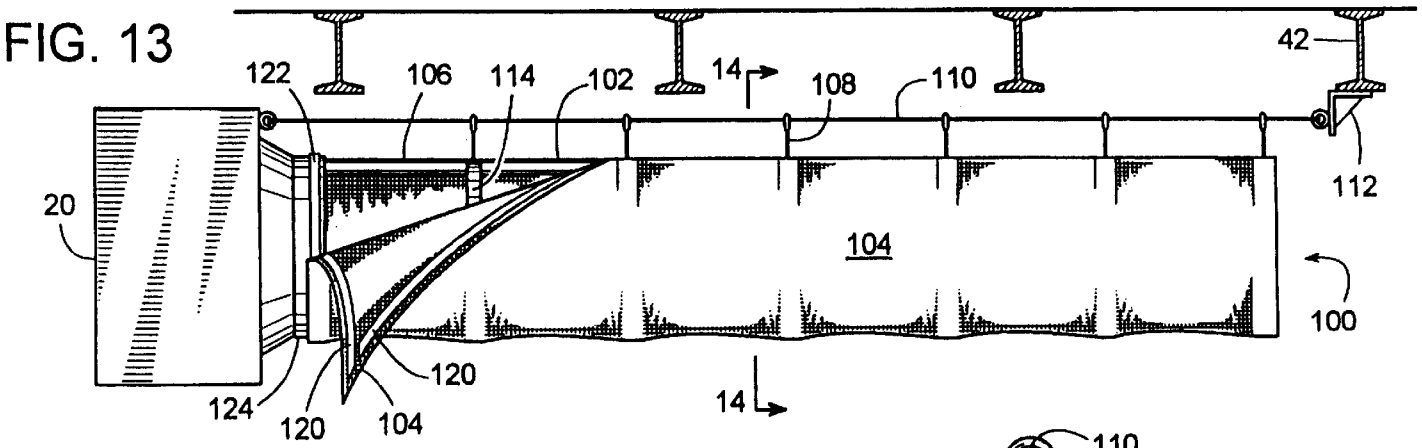
FIG. 13 is a side view of another embodiment, but with a portion of the fabric outer casing pulled away from the support frame.
Figure 14:
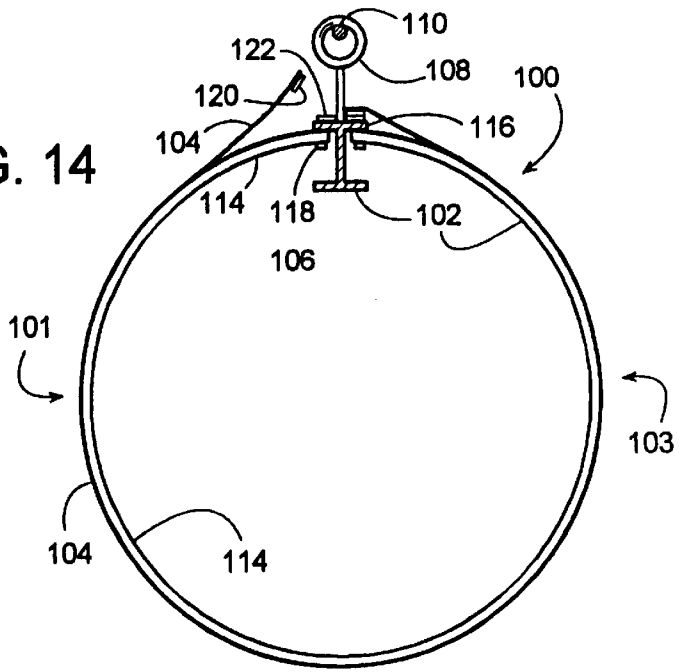
FIG. 14 is a sectional view taken along line 14—14 of FIG. 13.

In FIGS. 13 and 14, another fabric duct 100 whose frame 102 holds two horizontally opposing sides 101 and 103 of a fabric casing 104 open when deflated also allows the casing to be removed without having to slide it out from one end of the frame. This feature may be valuable in applications with limited space at the end of the duct. In one exemplary embodiment, frame 102 includes a light-duty I-beam 106 suspended by several ring connectors 108 strung through an overhead taut cable 10. In this example, cable 110 extends between supply header 20 and a bracket 112 attached to I-beam 42. To hold casing 104 open when deflated, several generally rigid hoops 114 are attached to the underside of an upper flange 116 of beam 106 by way of a conventional fastener 118. The edges of casing 104 includes one half of a touch and hold fastener 120 with its mating half 122 disposed atop upper flange 116 and around a discharge outlet 124 of air supply 20. To removably install casing 104, it is wrapped around hoops 114 and outlet 124 to engage the mating halves of touch and hold fasteners 120 and 122.

Although the invention is described with reference to a preferred embodiment, it should be appreciated by those skilled in the art that various modifications are well within the scope of the invention. Therefore, the scope of the invention is to be determined by reference to the claims that follow.

We claim:

1. An elongated air duct adapted to be coupled to an overhead portion of a building and defining a plurality of discharge apertures distributed along a length of the elongated air duct, comprising:

a frame adapted to be coupled to the overhead portion of the building and extending along the length of the elongated air duct;

a flexible fabric supported by the frame and having two horizontally opposing sides that are held apart by the frame to create an air passageway therebetween that runs along the length of the elongated air duct, whereby the air passageway exists even in the absence of any airflow therethrough; and a panel that is more rigid than the flexible fabric and is suspended from the flexible fabric at a position below the frame, wherein the panel defines the plurality of discharge apertures.

2. The elongated air duct of claim 1, further comprising a cover plate slidingly attached to the panel and defining a second plurality of apertures that are selectively aligned and misaligned to the plurality of discharge apertures by way of sliding the cover plate in relation to the panel, whereby sliding the cover plate selectively opens and closes the plurality of discharge apertures to adjust a rate of airflow that may discharge therethrough.

3. An elongated air duct adapted to be coupled to an overhead portion of a building and defining a plurality of discharge apertures distributed along a length of the elongated air duct, comprising:

a frame including two horizontally spaced apart attachment members adapted to be coupled to the overhead portion of the building and extending along the length of the elongated air duct;

a flexible fabric having two horizontally opposing sides that are spaced apart from each other by hanging from the two horizontally spaced apart attachment members, the two horizontally opposing sides being spaced apart create an air passageway therebetween that runs along the length of the elongated air duct, whereby the air passageway exists even in the absence of any airflow therethrough; and a panel that is more rigid than the flexible fabric and is suspended from the flexible fabric at a position below the frame, wherein the panel defines the plurality of discharge apertures.

4. The elongated air duct of claim 3, further comprising a cover plate slidingly attached to the panel and defining a second plurality of apertures that are selectively aligned and misaligned to the plurality of discharge apertures by way of sliding the cover plate in relation to the panel, whereby sliding the cover plate selectively opens and closes the plurality of discharge apertures to adjust a rate of airflow that may discharge therethrough.

5. An elongated air duct adapted to be coupled to an overhead portion of a building and defining a plurality of discharge apertures distributed along a length of the elongated air duct, comprising:

a frame adapted to be coupled to the overhead portion of the building and extending along the length of the elongated air duct;

a flexible fabric supported by the frame and having two horizontally opposing sides that are held apart by the frame to create an air passageway therebetween that runs along the length of the elongated air duct and exists even in the absence of any airflow therethrough; and a panel that is more rigid than the flexible fabric and suspended therefrom at a position below and spaced apart from the frame, wherein the panel defines the plurality of discharge apertures.

6. The elongated air duct of claim 5, further comprising a cover plate slidingly attached to the panel and defining a second plurality of apertures that are selectively aligned and misaligned to the plurality of discharge apertures by way of sliding the cover plate, whereby sliding the cover plate selectively opens and closes the plurality of discharge apertures to adjust a rate of airflow that may discharge therethrough.

7. An air duct comprising:

a tubular casing that includes a fabric wall and defines a first plurality of apertures; and a covering member with a second plurality of apertures capable of variable registration with the first plurality of apertures to vary a rate of airflow therethrough, wherein the covering member defines a third plurality of apertures capable of variable registration with the first plurality of apertures to vary a rate of airflow therethrough, wherein the second plurality of apertures are distinguishable from the third plurality of apertures by way of at least one of a shape and a size thereof.

8. An air duct comprising:

a tubular casing that includes a fabric wall and defines a first plurality of apertures; and a covering member with a second plurality of apertures capable of variable registration with the first plurality of apertures to vary a rate of airflow therethrough, wherein the tubular casing defines a third plurality of apertures capable of variable registration with the second plurality of apertures to vary a rate of airflow therethrough, wherein the first plurality of apertures are distinguishable from the third plurality of apertures by way of at least one of a shape and a size thereof.

* * * * *